US006107554A

United States Patent [19]

Riddle

[11] Patent Number: 6,107,554

[45] Date of Patent: Aug. 22, 2000

[54] CAPO FOR A FIVE-STRING BANJO

[76] Inventor: Stan W. Riddle, P.O. Box 1044, Lewisville, N.C. 27023

[21] Appl. No.: 09/337,288

[22] Filed: Jun. 21, 1999

[51] Int. Cl.[7] ..... G10D 3/12

[52] U.S. Cl. ..... 84/300; 84/318

[58] Field of Search ..... 84/300, 318

[56] References Cited

U.S. PATENT DOCUMENTS

| | | | |
|---|---|---|---|
| 394,530 | 12/1888 | Wood . | |
| 416,057 | 11/1889 | Gill et al. | 84/318 |
| 3,227,028 | 1/1966 | Simms | 84/318 |
| 3,329,055 | 7/1967 | Milliken | 84/318 |
| 3,834,267 | 9/1974 | Shubb et al. | 84/318 |
| 3,903,776 | 9/1975 | Owen, III | 84/318 |
| 4,183,279 | 1/1980 | Shabram, Jr. | 84/318 |
| 4,195,546 | 4/1980 | Urbank | 84/318 |
| 4,583,440 | 4/1986 | Powell, Jr. | 84/318 |
| 4,671,156 | 6/1987 | Hathcock | 84/318 |
| 4,823,670 | 4/1989 | Gherman et al. | 84/318 |
| 4,926,732 | 5/1990 | Collins et al. | 84/318 |
| 5,081,894 | 1/1992 | Paige | 84/318 |
| 5,623,110 | 4/1997 | Hoglund et al. | 84/318 |

*Primary Examiner*—Jeffrey Donels

*Attorney, Agent, or Firm*—Rhodes & Mason, PLLC

[57] ABSTRACT

A five-string banjo having a tuning key for a fifth string and a capo for controlling the musical key of the fifth string of the banjo. The capo includes a set of tuner rods. Each tuner rod has an upper hook for mounting to the tuning key; a shaft section extending from the upper hook and extending along a length of the neck of the banjo; and a string connect attached to the end of the shaft opposite the upper hook and extending over the fifth string to providing a downward force on the fifth string. The length of the shaft section of each of the tuner rods is a different length for selective tuning of the musical key of the fifth string. In the preferred embodiment, the invention includes a positioner attached to the tuning key for providing a contact surface to position each of the tuner rod with respect to the fifth string. The positioner may be a "C-shaped" washer removably attachable around the shaft of the tuning key or a circular washer having a central aperture for receiving the shaft of the tuning key. In the preferred embodiment a plurality of positioners are attached to the tuning key for providing at least two positions with respect to the fifth string for the tuner rod. In addition, at least one of the positioners is a spacer to secure the other positioners in place for noise abatement during playing.

26 Claims, 3 Drawing Sheets

CAPO FOR A FIVE-STRING BANJO

BACKGROUND OF THE INVENTION (1) Field of the Invention

The present invention relates generally to musical instruments and, more particularly, to a five-string banjo having a capo which attaches to the neck of the banjo for controlling the musical key of the fifth string of the banjo.

(2) Description of the Prior Art

A conventional five-string banjo includes four tuning keys positioned at the top end of the banjo neck for controlling the tension and tuning the first four banjo strings. The fifth string tuning key is mounted along the banjo neck remote from the first four tuning keys. The fifth string tuning key extends outward from the banjo neck, and like the other four tuning keys includes a finger grip that is rotated to control the tension and tuning of the attached string.

One common method for controlling the musical key of the fifth string is to insert pegs between the fret board and the edge of the banjo neck. These pegs usually have a short length of less than about ½" and once inserted, extend outward to allow a player to hook the fifth string to control the tuning. One major drawback of using pegs is the permanent markings on the neck and face of the banjo. Specifically, when the pegs are removed, the mounting holes remain damaging the aesthetic appearance of the banjo and also the value, which is especially important considering many high end banjos cost thousands of dollars. Another disadvantage of the pegs is that the fifth string may become unseated during playing thereby interrupting the player and causing him or her to have to reseat the string before continuing to play.

Another common manner for controlling the fifth string is to place a capo that extends about the circumference of the banjo neck. This type of capo most often extends underneath the strings and includes an arm or other similar device that extends outward for capturing the fifth string. A drawback of this type of capo is that it often interferes with the strings resulting in a poorer quality of music. This capo may also interfere with the player as he or she moves their hand along the banjo neck.

Thus, there remains a need for a capo which can control a fifth string of a banjo which is easy to mount onto the banjo without permanently damaging the banjo while, at the same time, can be easily adjusted along the length of the fifth string to control the fifth string even during hard playing.

SUMMARY OF THE INVENTION

The present invention is directed to a five-string banjo having a tuning key for a fifth string and a capo for controlling the musical key of the fifth string of the banjo. The capo includes a set of tuner rods. Each tuner rod has an upper hook for mounting to the tuning key; a shaft section extending from the upper hook and extending along a length of the neck of the banjo; and a string connect attached to the end of the shaft opposite the upper hook and extending over the fifth string to providing a downward force on the fifth string. The length of the shaft section of each of the tuner rods is a different length for selective tuning of the musical key of the fifth string.

In the preferred embodiment, the invention includes a positioner attached to the tuning key for providing a contact surface to position each of the tuner rod with respect to the fifth string. The positioner may be a "C-shaped" washer removably attachable around the shaft of the tuning key or a circular washer having a central aperture for receiving the shaft of the tuning key. In the preferred embodiment a plurality of positioners are attached to the tuning key for providing at least two positions with respect to the fifth string for the tuner rod. In addition, at least one of the positioners may be used as a spacer to secure the other positioners in place for noise abatement during playing.

Accordingly, one aspect of the present invention is to provide a string musical instrument including: a five-string banjo having a tuning key for a fifth string; and a capo for controlling the musical key of the fifth string of the banjo, the capo including a tuner rod having: (i) an upper hook for mounting to the tuning key; (ii) a shaft section extending from the upper hook and extending along a length of the neck of the banjo; and (iii) a string connect attached to the end of the shaft opposite the upper hook and extending over the fifth string to providing a downward force on the fifth string.

Another aspect of the present invention is to provide a set of tuner rods for a five-string banjo having a tuning key for a fifth string, the set comprising: at least two tuner rods, each tuner rod having (i) an upper hook for mounting to the tuning key; (ii) a shaft section extending from the upper hook and extending along a length of the neck of the banjo; and (iii) a string connect attached to the end of the shaft opposite the upper hook and extending over the fifth string to providing a downward force on the fifth string, wherein the length of the shaft section of each of the tuner rods is a different length for selective tuning of the musical key of the fifth string.

Still another aspect of the present invention is to provide a string musical instrument including: a five-string banjo having a tuning key for a fifth string; a capo for controlling the musical key of the fifth string of the banjo, the capo including a set of tuner rods, the set comprising: at least two tuner rods, each tuner rod having (i) an upper hook for mounting to the tuning key; (ii) a shaft section extending from the upper hook and extending along a length of the neck of the banjo; and (iii) a string connect attached to the end of the shaft opposite the upper hook and extending over the fifth string to providing a downward force on the fifth string, wherein the length of the shaft section of each of the tuner rods is a different length for selective tuning of the musical key of the fifth string; and a positioner attached to the tuning key for providing a contact surface to position each of the tuner rod with respect to the fifth string.

These and other aspects of the present invention will become apparent to those skilled in the art after a reading of the following description of the preferred embodiment when considered with the drawings.

DESCRIPTION OF THE PREFERRED EMBODIMENT

Figure 1:
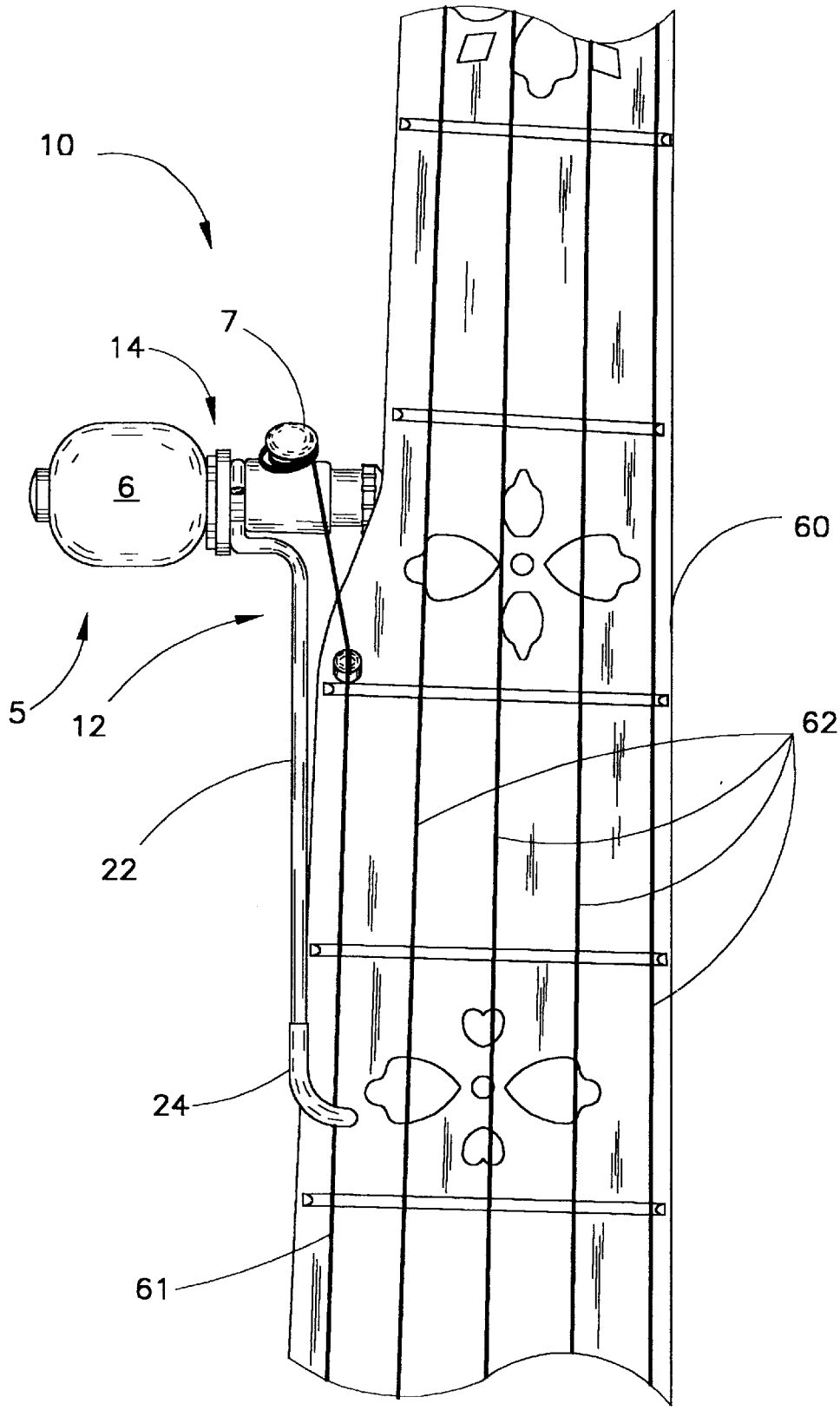
FIG. 1 is a perspective view of the neck of a five-string banjo having a capo constructed according to the present invention attached to the fifth string tuning key of the banjo.
Figure 3:
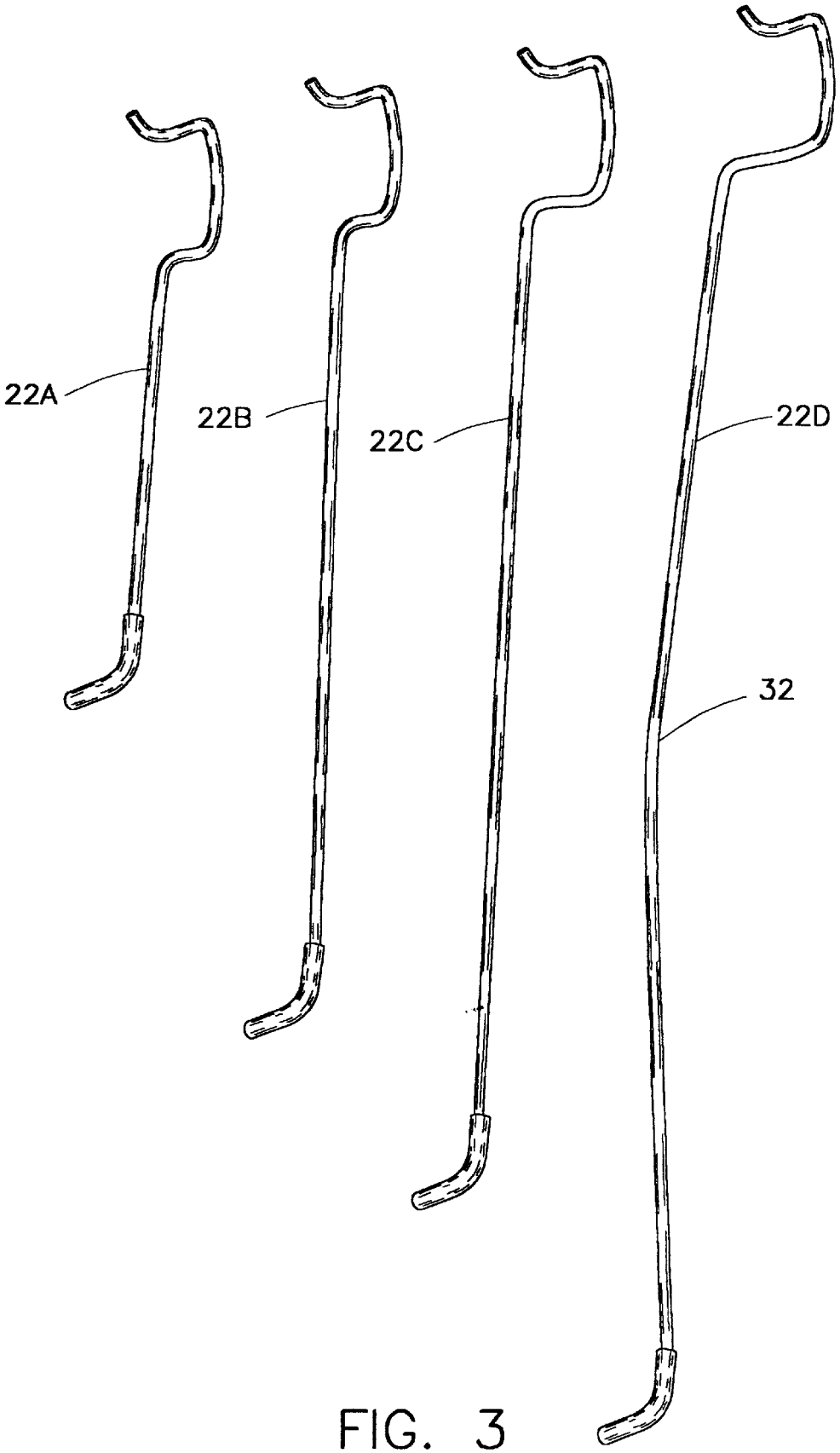
FIG. 3 is a side view of a set of tuner rods having varying shaft lengths for tuning the banjo fifth string along its length.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

A conventional banjo design includes a banjo having five strings extending along the banjo neck 60. The first four strings 62 extend the entire length of the neck and attach to tuning keys positioned at the neck end. The fifth string 61 extends a lesser distance along the banjo neck and attaches to a fifth string tuning key 5, positioned on the banjo neck 60. The fifth string 61 wraps around a spool 7 extending outward from the fifth string tuning key. A finger grip 6 is attached to spool 7 and is rotated to tighten or loosen the tension on the fifth string 61.

Referring now to the drawings in general and FIG. 1 in particular, it will be understood that the illustrations are for the purpose of describing a preferred embodiment of the invention and are not intended to limit the invention thereto. As best seen in FIG. 1, a fifth string capo, generally designated 10, is shown constructed according to the present invention. The fifth string capo 10 includes a tuner rod 12 and a positioner 14. The tuner rod 12 includes an upper hook 20, a shaft 22, and a string connect 24. The positioner 14 is attached to the fifth string tuning key 5 of the banjo for mounting the tuner rod 12 in position to exert a downward force onto the fifth string 61 to control it.

Figure 2:
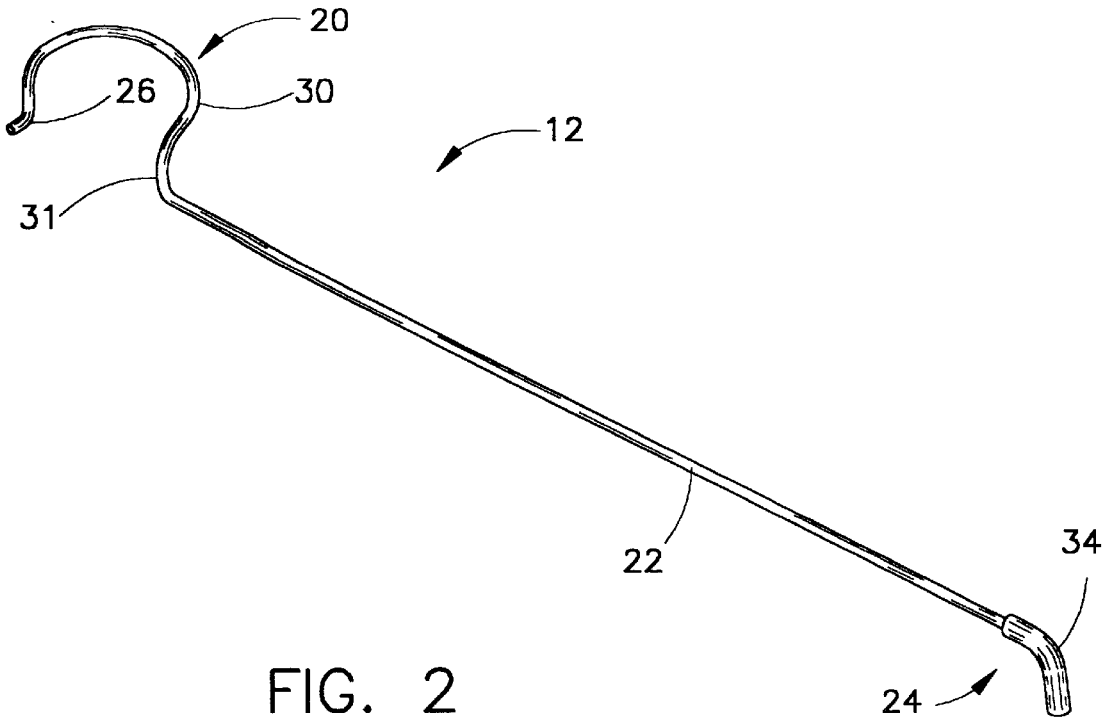
FIG. 2 is a perspective view of the tuner rod of the fifth string capo removed from the banjo and viewed from the bottom.

As best seen in FIG. 2, in the preferred embodiment, upper hook 20 includes a first section 26 that extends around spool 7 to secure one end of the tuner rod, and a second section 30 that extends behind the fifth string tuning key 5 when viewed from the banjo front. An arm 31 extends from the second section 30 towards the body of the banjo for positioning the shaft 22 along the side of the banjo neck 60 so as not to interfere with the player's playing the banjo.

A string connect 24 is positioned at the end of shaft 22 for extending transversely across the banjo neck 60 to maintain a downward pressure on the fifth string 61 to control it. Preferably, the string connect 24 includes a protective elastomeric covering 34, which helps to maintain the fifth string 61 in position under the string connect 24 and to reduce scratching or damage to the banjo neck and face. While, in the preferred embodiment, the string connect 24 is adapted for only the fifth string, it could be extended to contact more than one string if needed for a special playing situation.

As can appreciated, the design of the present invention provides for the tuner rod 12 to be easily attached and disconnected from the fifth string tuning key 5 since by merely moving the string connect end 24 of the shaft 22 away from the neck of the banjo, the tuner rod 12 can be rotated downwardly and removed from the tuner key 5.

Figure 4:
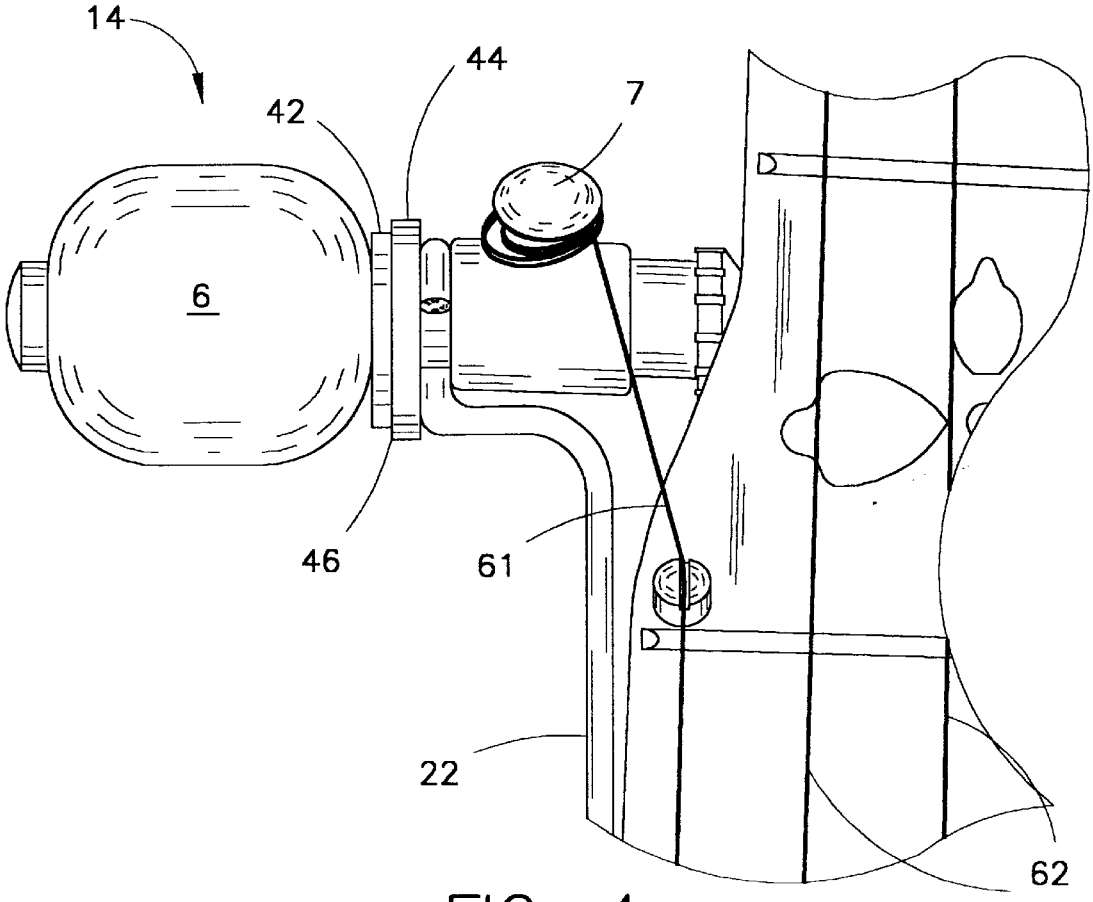
FIG. 4 is an enlarged top view of a positioner for aiding in attaching the tuner rod to the tuning key.
Figure 1:
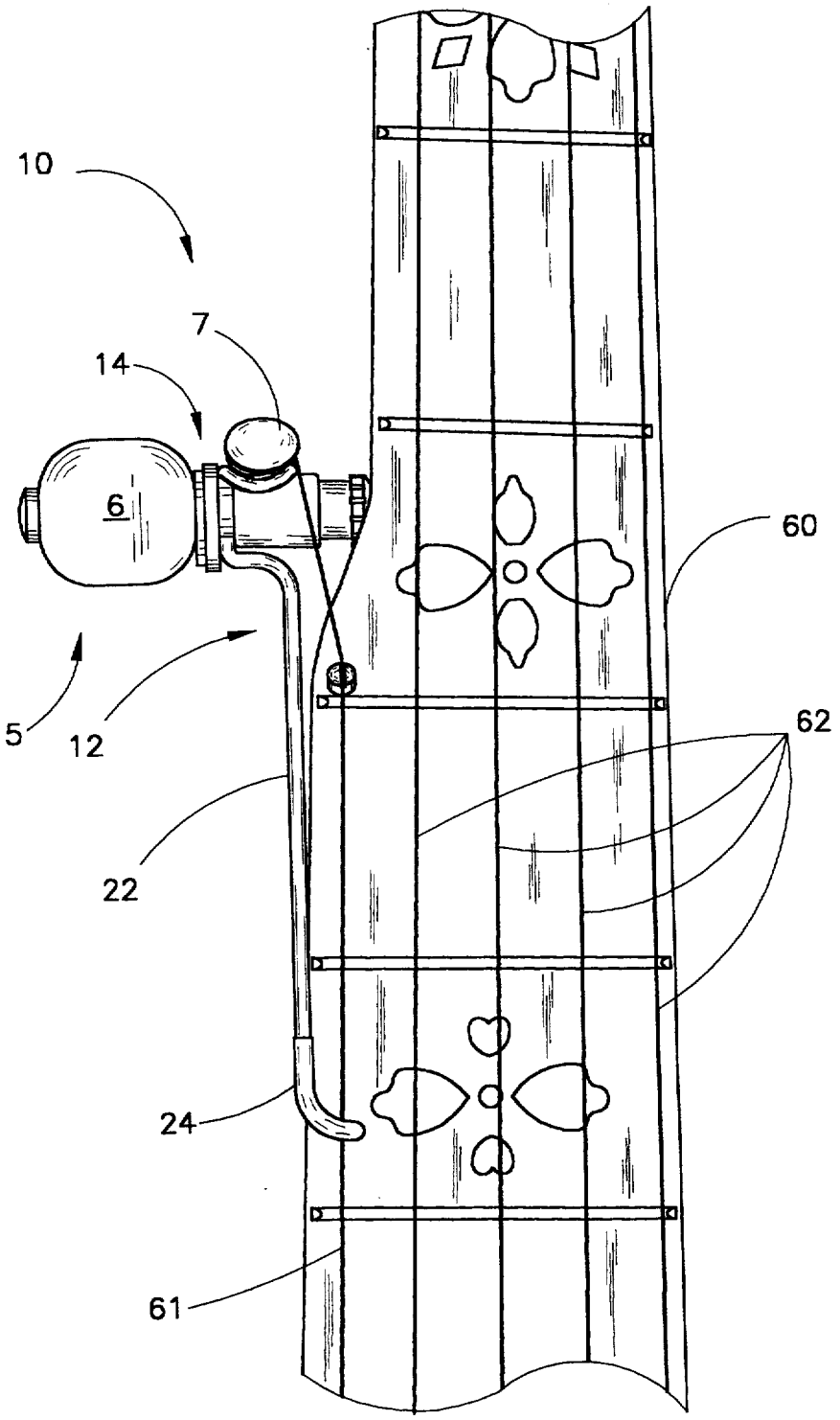
Figure 2:
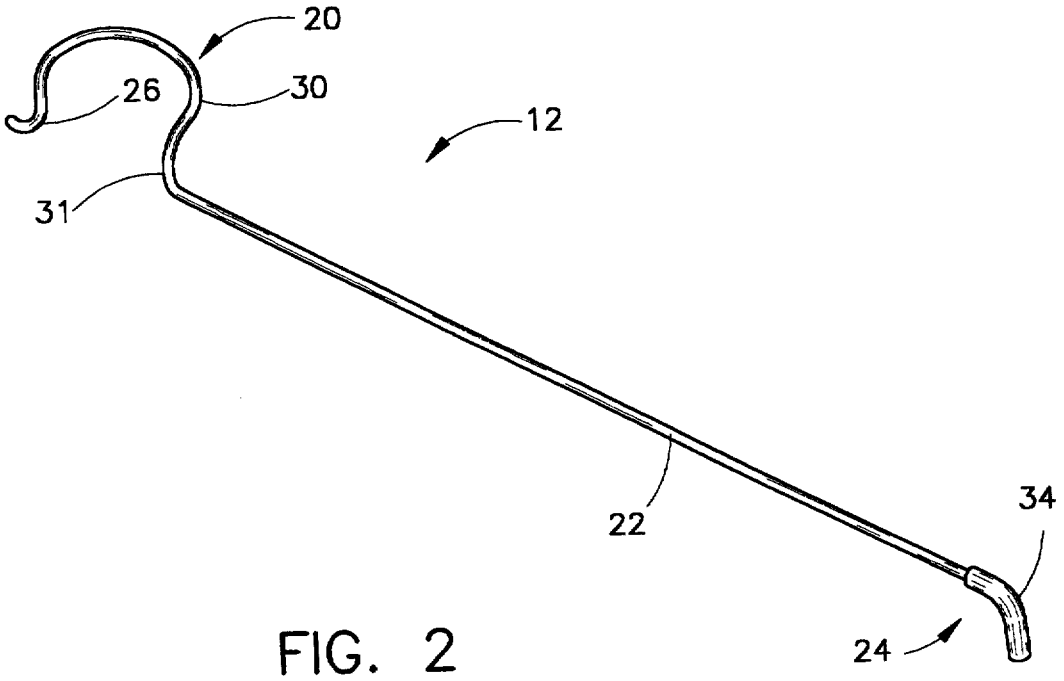
Figure 4:
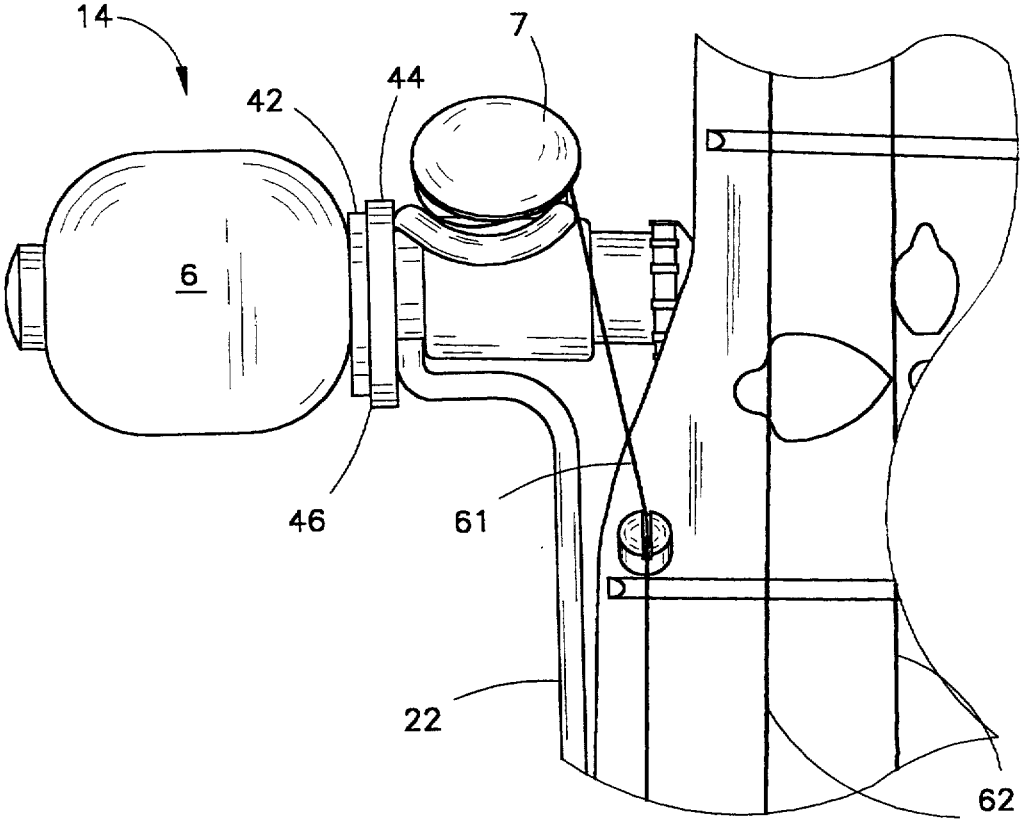

As illustrated in FIG. 4, the shaft 22 may have a number of lengths depending upon the key at which the capo 10 is to hold the fifth string. By way of example, the tuner rod illustrated as 22A has a shaft that extends the distance to hold the fifth sting 61 with an A note, 22B has a length for a B note, 22C obtains a C note, and 22D obtains a D note. The length of shaft 22 may vary depending upon the particular make and model of the banjo.

While, in the preferred embodiment, the capo 10 includes a set of tuner rods 12 of various lengths, a single tuner rod 12 having an adjustable length shaft 22 could be used. There are many known ways to adjust the length of a shaft including tumbuckles and telescoping sleeves.

Tuner rod 12 is preferably constructed of metal, such as a 26 gauge (about 1/16 inch diameter) stainless steel wire. Preferably, the wire has a high yield strength for maintaining its shape when it is used on the banjo. Shaft 22 may further include an arch 32 along its length to help maintain pressure on the fifth string 61 for longer shafts.

As best seen in FIG. 4, positioners 14 may be mounted on the fifth string tuning key 5 to position the capo. The positioners 14 allow for the capo 10 to be mounted such that it provides force on the fifth string 61 and provides for a secure fit of the tuner rod 12 on the tuning key 5 by providing a support surface for the upper hook 20. FIG. 4 illustrates positioners 14 wherein a first diameter washer 42, preferably nylon or other polymeric material, and a second diameter washer 44 provide support for the tuner rod 12; and a third washer 46, also made of a polymeric material such as nylon, may be used as a spacer to secure the positioner 14 in place to help prevent the positioner 14 from making noise during playing. Third washer 46 may be a pre-existing part of the tuning key 5. The positioners may take on a variety of shapes including a circular washer shape, which is inserted onto the shaft of the fifth string tuning key 5, and a C-shaped disc, which may be inserted directly over the tuning key shaft without disassembling the tuning key first.

In use, a performer preparing to play the banjo chooses the appropriate size tuner rod with the correct shaft length for the particular type of music. The tuner rod is positioned on the fifth string tuning key 5 such that the upper hook 26 wraps about the spool 7 and around the tuner key to position the shaft 22 along the banjo neck. The tuner rod 12 is positioned such that the string connect 24 is placed below the fret board of the banjo. The performer lifts the shaft 22 and places the string connect 24 over the fifth string 61, as illustrated in FIG. 1. The resilient nature of the tuner rod 12 provides for downward pressure to hold down the fifth string 61. This tension is adequate even when hard "picking" is performed. When the performer has finished, the string connect 24 is lifted and pulled away from the banjo resulting it to rotate below the fret board and be easily removed from the fifth string tuning key.

Certain modifications and improvements will occur to those skilled in the art upon a reading of the foregoing description. By way of example, while stainless steel is the preferred material, other high strength materials such as graphite or fiber impregnated plastics could be used. It should be understood that all such modifications and improvements have been deleted herein for the sake of conciseness and readability but are properly within the scope of the following claims.

I claim:

1. A string musical instrument comprising:

(a) a five-string banjo having a tuning key for a fifth string; and (b) a capo for controlling the musical key of said fifth string of said banjo, said capo including a tuner rod having: (i) an upper hook for mounting to said tuning key; (ii) a shaft section extending from said upper hook and extending along a length of the neck of said banjo; and (iii) a string connect attached to the end of said shaft opposite said upper hook and extending over said fifth string to providing a downward force on said fifth string.

2. The apparatus of claim 1, further including a positioner attached to said tuning key for providing a contact surface to position said tuner rod with respect to said fifth string.

3. The apparatus of claim 2, wherein said positioner is a "C-shaped" washer removably attachable around the shaft of said tuning key.

4. The apparatus of claim 2, wherein said positioner is a circular washer having a central aperture for receiving the shaft of said tuning key.

5. The apparatus of claim 2, wherein a plurality of positioners are attached to said tuning key for providing at least two positions with respect to said fifth string for said tuner rod.

6. The apparatus of claim 5, wherein at least one of said positioners is a spacer to secure the other positioners in place for noise abatement during playing.

7. A set of tuner rods for a five-string banjo having a tuning key for a fifth string, said set comprising: at least two tuner rods, each tuner rod having (i) an upper hook for mounting to said tuning key; (ii) a shaft section extending from said upper hook and extending along a length of the neck of said banjo; and (iii) a string connect attached to the end of said shaft opposite said upper hook and extending over said fifth string to providing a downward force on said fifth string, wherein the length of the shaft section of each of said tuner rods is a different length for selective tuning of the musical key of said fifth string.

8. The apparatus of claim 7, wherein said upper hook includes a first angled section for extending around said tuning key.

9. The apparatus of claim 8, further including a second angled section adjacent to said first angled section for mounting said tuner rod to said tuning key.

10. The apparatus of claim 7, wherein said shaft is substantially straight.

11. The apparatus of claim 7, wherein said shaft includes an arch that extends above the neck of said banjo for assisting in maintaining downward pressure on said fifth string.

12. The apparatus of claim 7, wherein said string connect includes a protective elastomeric covering for preventing scratching and other damage to the banjo.

13. The apparatus of claim 7, wherein each of said tuner rods is formed from a metal having a high yield strength.

14. The apparatus of claim 13, wherein each of said tuner rods is formed from a 26-gauge stainless steel rod.

15. A string musical instrument comprising:

(a) a five-string banjo having a tuning key for a fifth string;

(b) a capo for controlling the musical key of said fifth string of said banjo, said capo including a set of tuner rods, said set comprising: at least two tuner rods, each tuner rod having (i) an upper hook for mounting to said tuning key; (ii) a shaft section extending from said upper hook and extending along a length of the neck of said banjo; and (iii) a string connect attached to the end of said shaft opposite said upper hook and extending over said fifth string to providing a downward force on said fifth string, wherein the length of the shaft section of each of said tuner rods is a different length for selective tuning of the musical key of said fifth string; and (c) a positioner attached to said tuning key for providing a contact surface to position each of said tuner rod with respect to said fifth string.

16. The apparatus of claim 15, wherein said positioner is a "C-shaped" washer removably attachable around the shaft of said tuning key.

17. The apparatus of claim 15, wherein said positioner is a circular washer having a central aperture for receiving the shaft of said tuning key.

18. The apparatus of claim 15, wherein a plurality of positioners are attached to said tuning key for providing at least two positions with respect to said fifth string for said tuner rod.

19. The apparatus of claim 5, wherein at least one of said positioners is a spacer to secure the other positioners in place for noise abatement during playing.

20. The apparatus of claim 15, wherein said upper hook includes a first angled section for extending around said tuning key.

21. The apparatus of claim 20, further including a second angled section adjacent to said first angled section for mounting said tuner rod to said tuning key.

22. The apparatus of claim 15, wherein said shaft is substantially straight.

23. The apparatus of claim 15, wherein said shaft includes an arch that extends above the neck of said banjo for assisting in maintaining downward pressure on said fifth string.

24. The apparatus of claim 15, wherein said string connect includes a protective elastomeric covering for preventing scratching and other damage to the banjo.

25. The apparatus of claim 15, wherein each of said tuner rods is formed from a metal having a high yield strength.

26. The apparatus of claim 25, wherein each of said tuner rods is formed from formed from a 26-gauge stainless steel rod.

* * * * *

UNITED STATES PATENT AND TRADEMARK OFFICE
CERTIFICATE OF CORRECTION

PATENT NO : 6,107,554
DATED : August 22, 2000
INVENTOR(S) : Stan W. Riddle

It is certified that error appears in the above-identified patent and that said Letters Patent are hereby corrected as shown below:

Drawing:
Figures 1 and 4 as published to not clearly show upper hook 20. Substitute Figures 1 and 4 are submitted with this request for Certificate of Correction.

In Claim 1 (b), line 8, "providing" should be --provide--.

In Claim 7, line 8, "providing" should be --provide--.

In Claim 15 (b), line 9, "providing" should be --provide--.

Signed and Sealed this
First Day of May, 2001

*Attest:*

Nicholas P. Godici

NICHOLAS P. GODICI

*Attesting Officer*

*Acting Director of the United States Patent and Trademark Office*